US005463820A

United States Patent [19]

La Rue

[11] Patent Number: 5,463,820

[45] **Date of Patent: * Nov. 7, 1995**

[54] LINT FILTER

[76] Inventor: Len La Rue, 6970 Pembroke Dr., Reno, Nev. 89502

[ * ] Notice: The portion of the term of this patent subsequent to May 18, 2010, has been disclaimed.

[21] Appl. No.: 32,332

[22] Filed: Mar. 16, 1993

Related U.S. Application Data

[63] Continuation-in-part of Ser. No. 944,532, Sep. 14, 1992, Pat. No. 5,210,960.

[51] Int. Cl.[6] ..... F26B 21/06

[52] U.S. Cl. ..... 34/235; 34/82; 34/86

[58] Field of Search ..... 34/86, 235, 82, 34/80, 35; 454/359

[56] References Cited

U.S. PATENT DOCUMENTS 5,210,960 5/1993 La Rue ..... 34/82

*Primary Examiner*—Denise L. Gromada

[57] ABSTRACT

A lint filter having a container provided with a drawer. A fitting is associated with the container for connecting a hose from a clothes dryer or the like to the container while at least one aperture is provided adjacent the fitting for permitting air carrying the lint into the container to escape therefrom, a baffle is disposed within the container in order to form a flow path for the air and lint through a filter causing the lint to adhere thereto. Means for cleaning the filter include a stationary filter disc which has a working relationship and communicates with a rotating wiper blade fixidly attached to a shaft having a manually operated knob.

6 Claims, 2 Drawing Sheets

LINT FILTER

CROSS REFERENCE TO RELATED APPLICATION

The present invention is a continuation-in-part of Ser. No. 07/944,532, filed Sep. 14, 1992 and for which a "Notice of Allowance" has been received by the same inventor and which is incorporated herein by reference now U.S. Pat. No. 5,210,960.

FIELD OF THE INVENTION

This invention relates generally to a lint filter and particularly to a lint filter for filtering lint from a stream of air emanating from a clothes dryer or the like.

BACKGROUND OF THE INVENTION

A problem commonly encountered with the use of the conventional clothes dryer or the like is the disposal of lint separated from the clothes during the drying process. Frequently the exhaust gases from the dryer, together with the lint, dust particles, and the like, are merely dispersed into the atmosphere. Many of these known devices require water in a container without maintaining a water level, thus causing back pressure at times or too much clearance letting lint escape into the atmosphere.

U.S. Pat. No. 4,969,276, filed Sep. 27, 1989 by Robert Walsh discloses an air filter and humidifier combined using a water container causing maintenance problems. Further the device disclosed in U.S. Pat. No. 5,052,127, filed Sep. 21, 1990 consists of a lint bag to catch the lint after cleaning the inner bag filter. It is re-usable. The bag would need to be cleaned after each load to be effective, that being an inconvenience to keep it cleaned. Further in U.S Pat. No. 2,825, 148, issued Mar. 4, 1958, to E.C. Olsen, comprises a lint filter to trap the lint but which uses water in cleaning the filter—thus using an outside water supply along with drain pipes—making it not comparable. Further U.S. Pat. No. 4,905,340, filed Aug. 11, 1988, by Alan Gutschmit, a lint control apparatus more for industrial use has no easy means for cleaning. U.S. Pat. No. 3,111,018, issued Nov. 19, 1963 to J.J. Bonner and U.S. Pat. No. 4,115,485, issued to Richard J. Genessi: Both patents are using water to trap the lint.

The aforementioned patent application Ser. No. 07/944, 532, by the present inventor, overcomes many of the deficiencies of the above noted prior art and includes a unique and unusual lint filter, however, the present invention incorporates elimination of parts and includes an improved lint filter apparatus.

SUMMARY OF THE INVENTION

According to the present invention, by providing a lint filter having a container, a fitting provided on the container for connecting a hose to the container and placing the hose in communication with the container located inside the container and below the fitting a baffle is installed for deflecting air and lint from the dryer to form a flow path through the filter and associated apertures. As air passes through the filter, lint and particulate matter are adhering to the filter, thus clean air escapes to the atmosphere. A rotating wiper blade and stationary filter are means for cleaning the filter. The filter means being fixidly attached by means such as glue or other suitable means with a shaft being rotatably mounted there through, the shaft means protruding through the container and associated apertures, a knob on the outside of the container is fixidly attached to the rotatable shaft with a wiper blade being fixidly attached to the distal end of the rotating shaft, whereby allowing the knob, rotating shaft and the wiper blade to cooperate together when the knob is turned to rotate and remove lint and debris from the filter and a gravitational drop occurs disposing the lint and/or debris or particulate matter into a cleanout drawer located in the lower housing of the container.

It is therefore an object of the present invention to provide a lint filter that allows free passage of air or other fluid from a clothes dryer or the like, thus eliminating back pressure to the dryer.

It is also a primary object of the present invention to include a unique and unusual wiper blade apparatus which is an improvement over previous prior art.

It is yet another object of the present invention to provide a lint filter that is independent and does not require water.

A still further object of the present invention is to provide a lint filter completely self-contained, requiring very little maintenance.

Yet another object of the present invention is to provide an affordable lint filter.

Other objects and advantages will become apparent when taken into consideration with the following specifications and drawings.

BRIEF DESCRIPTION OF THE DRAWINGS

FIG. 1, is a partial schematic, perspective view showing a lint filter, according to the present invention, connected to a conventional clothes dryer or the like.

DETAILED DESCRIPTION OF THE DRAWINGS

Figure 1:
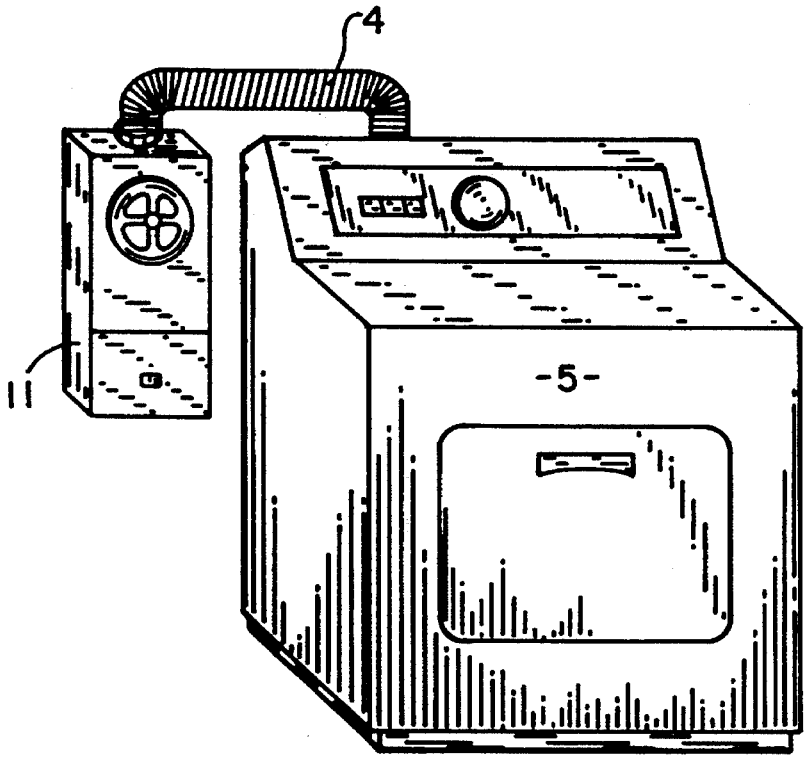

Referring now in detail to the drawings wherein like characters refer to like elements throughout the various drawings, in FIG. 1, a lint filter 11, according to the present invention, is shown attached to a conventional clothes dryer 5 as by a length of standard vent hose 4. It is to be understood that although the lint filter 11 is shown as having a substantially rectangular or cubical shape, the outer casing of the lint filter 11 can assume any shape or form with the important feature of the invention being the manner in which the filter, wiper blade and the cleaning mode is used and to be able to discharge nothing but clean air or the like.

Figure 2:
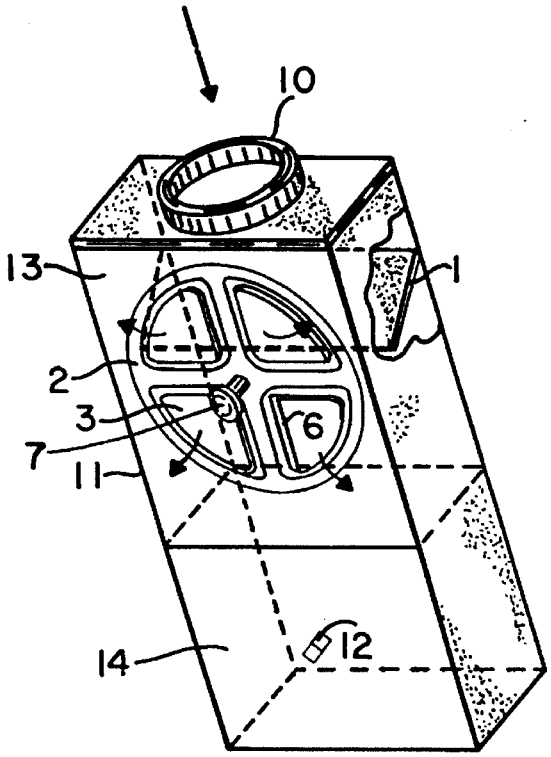
FIG. 2, is a full perspective view and the newly arranged lint filter and lint disposal drawer.
Figure 3:
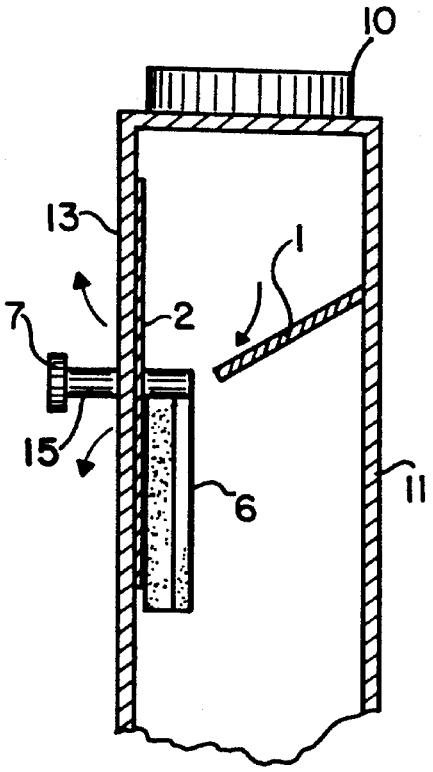
FIG. 3, is a sectionalized side view showing air flow direction and upper section containing disc filter and rotatable wiper blade.
Figure 4:
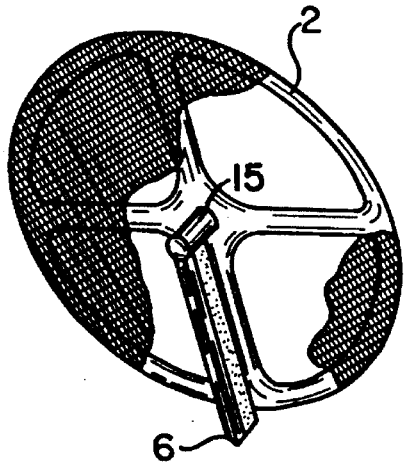
FIG. 4, is a view of the stationary disc filter and rotatable wiper blade only.

Referring now more particularly to FIGS. 2–4, of the drawings the lint filter 11 includes the housing, neck 10 of the filter housing 11 for connecting a vent house hose 4, as in FIG. 1, to the filter housing 11 and placing the vent housing hose 4 in communication with the filter housing 11. A baffle 1, is provided in the upper portion of the filter housing 11 and is arranged with the housing 11 for directing a flow path through the disc filter 2 and out four apertures 3, the disc filter 2 having a rotatable shaft 15 protruding through the face plate 13 and being fixidly attached to knob 7, a wiper blade 6 being fixidly attached to the distal end of shaft 15, such as by welding or other suitable means, and the moving parts being the rotatable shaft 15 which when rotated by the manually operated knob 7, allows the wiper blade 6 which is in contact with the stationary disc filter 2 assuring the lint (not showing) to coagulate, then dispose itself in the cleanout drawer 14 located in the lower section of housing 11.

It will now be seen that we have provided a lint filter that allows free passage of air or other fluid from a clothes dryer or the like, thus eliminating back pressure to the dryer.

It will also be seen that we have provided a lint filter that is independent and does not require water.

We have also provided an improved wiper blade apparatus which includes elimination of parts of previous prior art.

We have also provided a lint filter completely self-contained, requiring very little maintenance.

Also, we have provided a lint filter which is economical and inexpensive to manufacture.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described the invention, what I claim as new and desire to secure by letters patent is:

1. A lint filter in combination with a dryer having an air circulation system, said system having an exhaust blower and a discharge vent comprising; a chamber, said chamber having an input vent, means to attach said input vent of said chamber to said discharge vent of said dryer, a baffle, said baffle being disposed within said chamber forming first and second compartments, said second compartment being located below said first compartment, said second compartment having means to remove accumulated materials, said first compartment having an exhaust vent, a disc filter, means to fixidly mount said disc filter with said exhaust vent, a wiper blade, said wiper blade having mounting means to affix to a shaft, said wiper blade being in communication and having a working relationship with said disc filter, means to rotate said shaft, whereby, when exhaust air from said exhaust blower of said dryer is directed into said input vent of said chamber of said lint filter, said baffle directs said exhaust air thru substantially the top half of said disc filter and when said shaft is rotated, said wiper blade wipes material accumulated on said disc filter into said second compartment.

2. The lint filter of claim 1 in which said means to attach said input vent of said chamber to said discharge vent of said dryer is a flexible hose.

3. The lint filter of claim 1 in which said means to remove accumulated material is a drawer.

4. The lint filter of claim 1 in which said means to rotate said shaft is a knob.

5. The lint filter of claim 1 in which said means to fixidly mount said disc filter to said exhaust vent is by glue.

6. The lint filter of claim 1 in which said mounting means to affix said wiper blade to said shaft is by welding.

* * * * *